United States Patent [19]

Nolan

[11] 4,221,008

[45] Sep. 9, 1980

[54] SWIMMING POOL CHAIR LIFT

[76] Inventor: J. E. Nolan, P.O. Box 43243, Louisville, Ky. 40243

[21] Appl. No.: 31,858

[22] Filed: Apr. 20, 1979

[51] Int. Cl.[3] ..... E04H 3/16; A47K 3/12

[52] U.S. Cl. ..... 4/496; 4/185 L; 4/563; 297/347

[58] Field of Search ..... 4/172, 185 L, 185 S, 4/251, 185 R, 134, 185 AB; 414/662-664, 921; 5/81, 86; 297/345-347, 349, DIG. 10; 248/404, 415

[56] References Cited

U.S. PATENT DOCUMENTS

| | | | |
|---|---|---|---|
| 2,858,952 | 11/1958 | Ruppe et al. | 414/662 X |
| 3,071,779 | 1/1963 | Turner | 4/185 L |
| 3,280,409 | 10/1966 | Cotner | 4/185 L |
| 3,815,163 | 6/1974 | Sullivan | 4/185 L |
| 3,958,282 | 5/1976 | Crowe | 4/185 L |
| 3,994,030 | 11/1976 | Cassell et al. | 4/185 L |
| 4,075,719 | 2/1978 | Sullivan | 4/185 L |
| 4,141,089 | 2/1977 | Krumbeck | 4/185 L |

*Primary Examiner*—Stuart S. Levy
*Attorney, Agent, or Firm*—Francis H. Boos

[57] ABSTRACT

A device for transporting objects vertically and in a helical pattern into and out of a pool of water or similar liquid including carrier means, hydraulic cylinder means adapted to receive the carrier means and be activated by a selected fluid at a selected pressure, guide means carried by the cylinder and adapted to follow a helical elongated cam means as the cylinder is moved vertically along the cam means into and out of the pool of liquid, frame means connecting the hydraulic cylinder and cam means to the structure of the pool. Pressurized fluid supply means are provided to selectively supply fluid at a selected pressure to the hydraulic means whereby the carrier can be lowered into or raised out of the pool while being rotated through an arc during a portion of the upward and downward travel of the hydraulic cylinder.

3 Claims, 4 Drawing Figures

SWIMMING POOL CHAIR LIFT

BACKGROUND OF THE INVENTION

The invention relates to an arrangement for lowering an object, for example a handicapped person, into a pool from a deck beside the pool where the person is rotated through an arc while being lowered into the pool and, likewise, is raised out of the pool and returned to the same position. Devices useful for aiding the handicapped have been in existence for many years. Particularly, various devices have been utilized for transporting individuals and more specifically handicapped or disabled individuals from place to place. One example of such arrangement is of course the wheelchair which has been in common use for many generations.

More recently, more sophisticated devices and therapy have been developed for aiding handicapped or disabled individuals. Such devices have included means for assisting handicapped or disabled individuals into and out of beds, or bathtubs and the like by various raising and lowering techniques.

In the treatment of certain disabilities or handicaps, modern therapy has resorted to the use of static and agitated pools of liquid for example, pools of water. In this connection no devices presently are known which can be utilized in raising or lowering a handicapped individual into and out of such pools where the individual can be seated onto a carrier at the edge of the pool and rotated and lowered into the pool with a minimum of discomfort or manipulation to provide the individual with the optimum relative position for ingress and egress to and from the device at both the raised and lowered positions.

Moreover, no device is presently known which is useful in raising or lowering a handicapped individual to accommodate the entry or exit from a pool which can be advantageously operated by the user himself.

SUMMARY OF THE INVENTION

The present invention is directed to a device which is particularly useful in the transportation of handicapped or disabled persons into and out of large pools of water used for therapy or other purposes.

The devices within the scope of the present invention are economical and straight forward in design with a minimum of moving parts to minimize maintenance and likelihood of damage to the device or injury to the person or thing being transported.

Moreover, some devices within the scope of the present invention provide arrangements where a user can easily move himself into a chair-like carrier which is located at the edge of the pool and can then activate the controls to transport himself into the pool where the chair swings through an arc while being lowered into the pool. The individual need not make any adjustment in his position during the upward or downward traverse of the chair.

Further, devices within the scope of the invention provide the means for the user to be lifted from the pool to the original starting position. The user can activate a hydraulic control which will cause the carrier to ascend out of the pool and turn through a reverse of the previous arc while ascending so as to allow the individual to disembark from the carrier at the pool ledge, in alignment, which will allow easy transfer into a wheel chair or other device if needed.

Devices in accordance with the present invention further accomplish the above described objectives utilizing an arrangement where only one moving part is required. The structure of devices within the scope of the present invention can be fabricated from generally available materials to provide further economies in construction.

Further, devices within the scope of the present invention can be designed and fabricated so that the hydraulic pressure necessary to operate the devices is provided by domestic water pressure where the inlet to the hydraulic device can be connected to a source of domestic water and the outlet from the hydraulic device, where the fluid is exhausted, can be located within the pool. Accordingly, devices within the scope of the present invention can be operated with only minimal energy consumption. Moreover, devices within the present invention can be operated without the use of excessively high pressures and without the use of electrical equipment which could injure persons using the devices.

It will be recognized that various other arrangements within the scope of the present invention will occur to those skilled in the art upon reading the disclosure set forth hereinafter.

BRIEF DESCRIPTION OF THE DRAWINGS

One example of an arrangement within the scope of the present invention is shown in the accompanying drawings in which:

Referring now to FIG. 1, the illustration is shown of one arrangement of a chair-lift device in accordance with the present invention adapted to move a person 1 from a position adjacent the deck 2 of a pool 3 into the pool 4 as shown in FIG. 1A. A chair-like carrier 6 is provided to hold the person during transport where the chair is connected by means of a collar 7 to outside 8 of a hydraulic cylinder, described hereinafter. Collar 7 is attached to chair 6 by means of a bracket 9. A cam follower arrangement 11, described more particularly hereinafter, is attached to the bottom of cylinder 8 and is adapted to ride on a cam 12, also described hereinafter, as cylinder 8 is raised and lowered. Cam 12 is connected to a bracket 13 located at the base of pool 3 and a vertical bracket 14 is provided to extend upwardly to be attached to a foot 16 which can be attached to pool deck 2 by means of bolts 17 or other fastners.

Cylinder 8 is adapted, as described hereinafter, to move in vertical alignment on cam 12 and to lower and rotate the user from the position 1 to the position shown in FIG. 1A.

Figure 2:
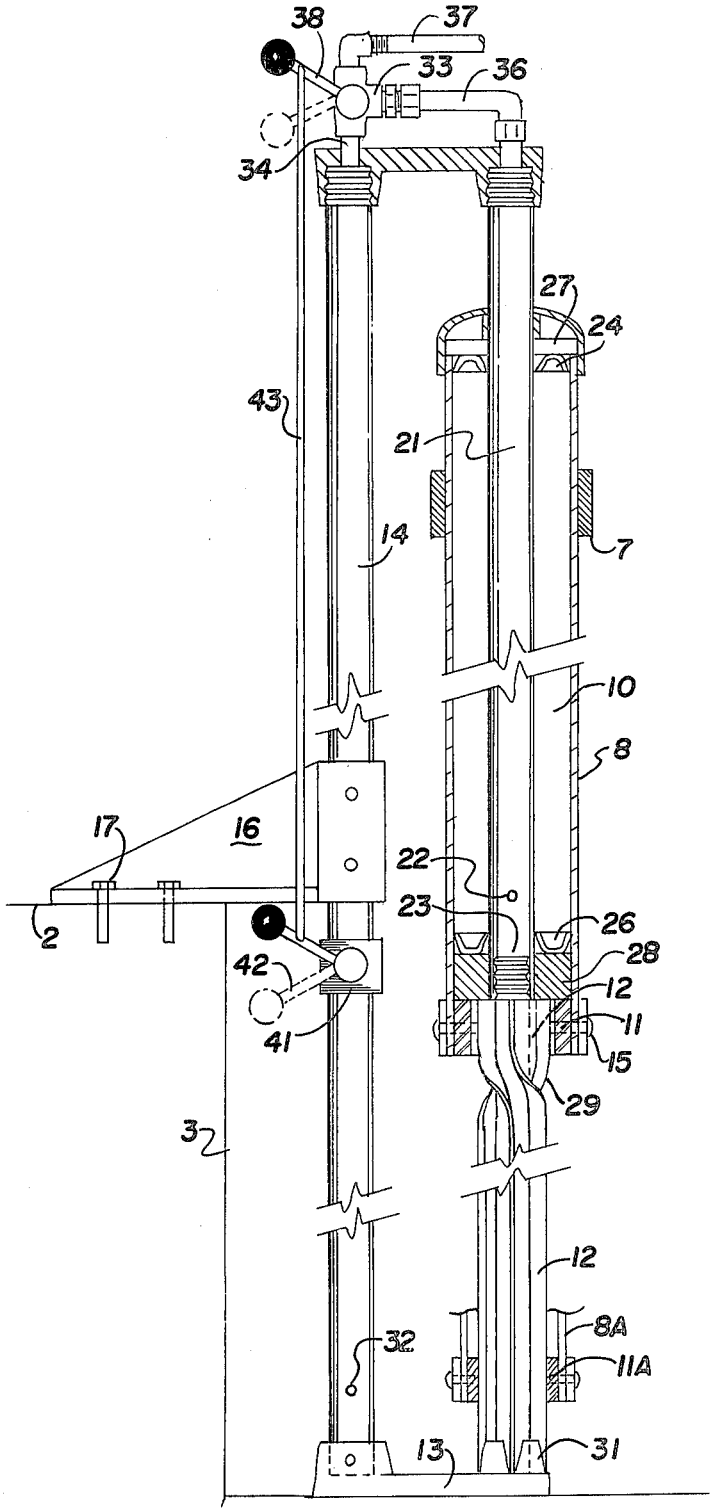
FIG. 2 is a sectional view of one example of an arrangement within the scope of the present invention as illustrated in FIG. 1.

With respect to FIG. 2, which shows the arrangement in more detail, cylinder 8 is shown in cross-section with a chamber 10 being defined between cylinder 8 and a vertical standpipe 21 having a water inlet 22 at the lower end thereof. A plug 23 is provided at the end of pipe 21 to prevent escape of water. The lower end of pipe 21 is connected to the upper end of cam 12.

Cup seal 24 and 26 are provided at opposite ends of cylinder 8 to provide a seal to prevent unnecessary escape of water between pipe 21 and the outer ends of cylinder 8, so that chamber 10 is essentially water-tight and pressure-tight. It will be noted that the supports 27 can be provided at the upper end of cylinder 8 to provide a structural support for seal 24 and an annular block 28 can be provided at the lower end to accomplish the same result with respect to seal 26.

Cam 12 is provided with a helical twist 29, which is received in cam follower 11, as described hereinafter, to accomplish a partial rotation of cylinder 8 and chair 6 during ascent and descent of cylinder 8. It will be noted that in its vertical travel cylinder 8 moves along shaft 21 and cam 12, which are stationary, to raise and lower chair 6.

Cam 12 can include splines adapted to enter matching slots in lower bracket 13 to retain cam 12 and pipe 21 in locked vertical orientation.

Likewise, 14 can be a pipe, as shown, having a water outlet 32. The upper end of pipe 14 communicates with a three-way valve 33 having one outlet 34 communicating with pipe 14 and one outlet 36 communicating with pipe 21.

Likewise a third opening 37 can be provided to valve 33 and connected, to a source of pressurized fluid, for example a source of domestic water. A valve handle 38 is provided to select the position of valve 33 as described hereinafter.

It will be recognized, that, within the scope of the present invention, the cross sectional area of the annular chamber 10 is advantageously sufficient, with available domestic water pressure to raise and lower cylinder 8 with the added weight of a patient to be manipulated. the selection of the diameter of cylinder 8 and the inlet pressure of the water is a matter of engineering calculation as is known in the art.

Figure 1:
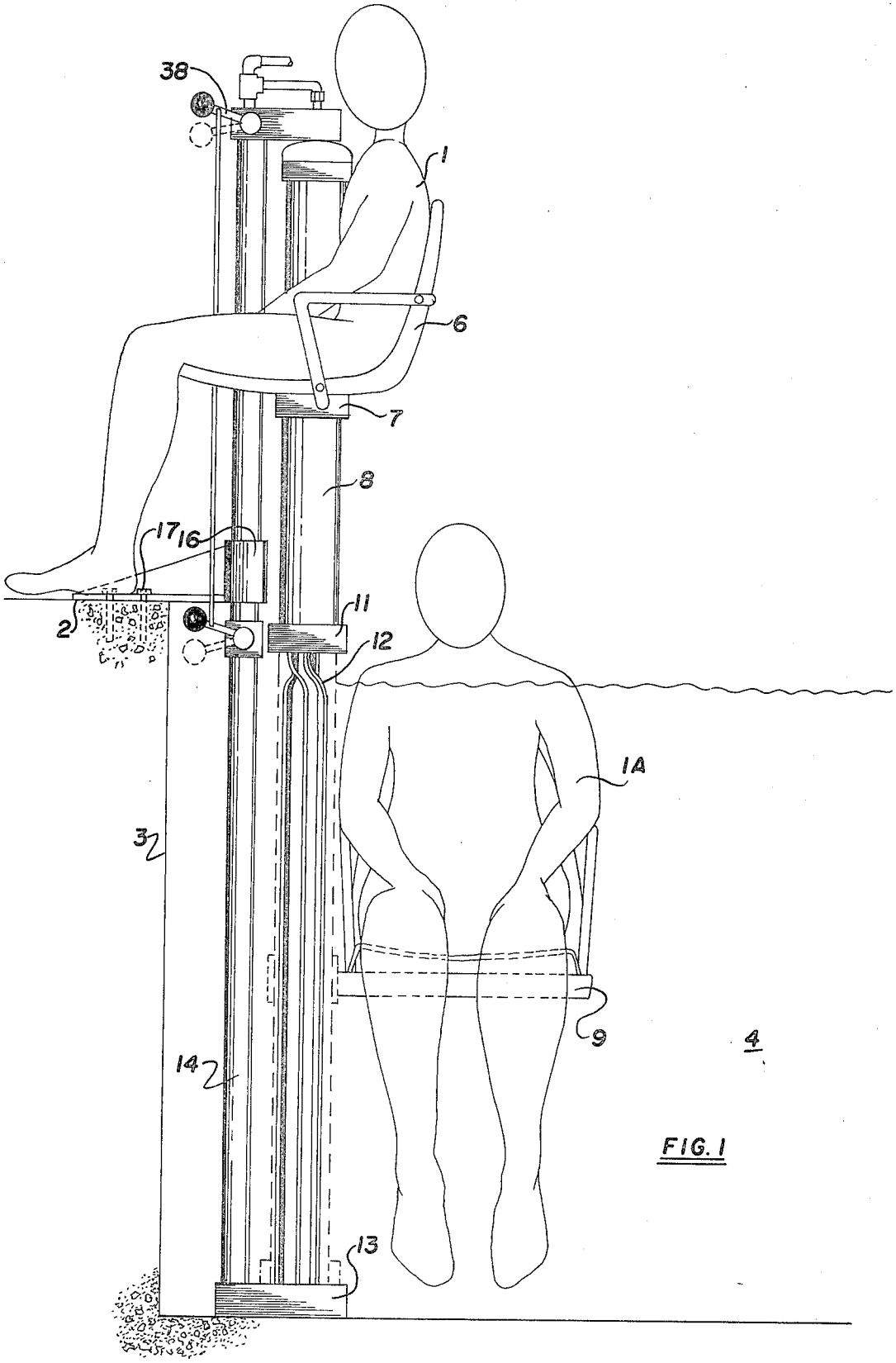
FIG. 1 is an illustration of an example of a lift device in accordance with the present invention utilized as a chair and showing the chair in two positions.

A second control handle 42 is provided at a position accessible to the patient when the chair is in the position 1A shown in FIG. 1. Handle 42 and handle 38 of valve 33 are interconnected by means of a connecting rod 43, so that the handles operate in tandem.

As previously described in connection with FIG. 1, bracket 9, which is adapted to carry chair 6, is attached to cylinder 8 for movement therewith by means of a collar 7. Within the scope of the present invention collar 7 can be adjustable on cylinder 8 to adapt to accommodate users of different size.

Likewise, pipe 14 is adapted to be adjustably received in shoe 16 to accommodate pools of varying depth.

Figure 4:
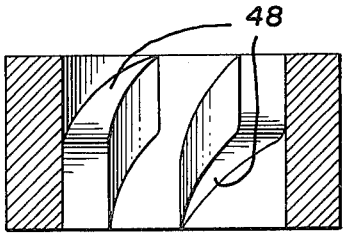
FIG. 4 is a view taken along a plane passing through line 4—4 of FIG. 3.
Figure 3:
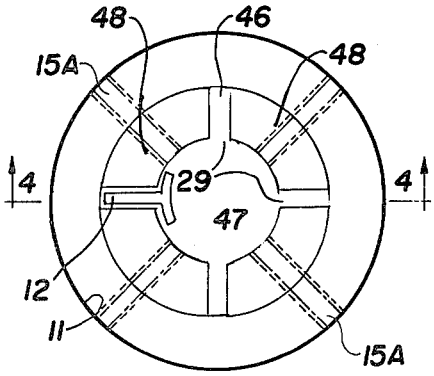
FIG. 3 is the example of the cam follower illustrated in FIG. 2.

Referring now to FIG. 3, which shows a cam follower 11 of the type shown in FIG. 1, the cam follower, when viewed from the top, includes passages 46, one passage for each cam spline 29 where the cam spines 29 are received as indicated and a central opening 47 is provided. To accommodate the helical portions of cam 29, inclined surfaces 48 are provided as shown in FIG. 3 and illustrated in FIG. 4 so that cam follower 11 rotates with the angle of inclination of helical sections 29. Advantageously, cam member 11 is adapted to be received within the outer periphery of cylinder 8 for movement therewith and retained by means fastners 15 secured in cooperative threaded apertures 15A of cam follower 11.

In operation, the user enters the chair in position 1 shown in FIG. 1A and activates valve lever 38 to activate valve 33 so the fluid retained in chamber 10 is emitted through inlet 22 to pipe 21 thence through valve 33, out port 34 and emitted into pool 4 through outlet 32. As fluid is emitted from annular chamber 10 cylinder 8 begins its downward travel. Initially, cam follower 11 engages helical section 29 of cam 12 and rotates cylinder 8 and chair 6 away from the surface of deck 2 and over the upper surface of pool 4. After follower 11 has passed helical section 29 of cam 12 and the splines of cam 12 are located within spaces 29 as shown in FIG. 3 cylinder 8 moves downwardly into pool 4 so the patient arrives in position 1A shown in FIG. 1.

When it is desired to lift the user from pool 4 the user sits in chair 6 in the position 1A shown in FIG. 1 and valve handle 42 is then moved to the second position, as shown in FIG. 1. By means of connecting arm 43, valve handle 38 moves to the position shown in dotted line in FIG. 2 so that water, under a selected pressure is emitted through inlet 37 to flow through valve 33 and inlet 36 to pipe 21 where it is emitted from outlet 22 into annular cavity 10 to raise cylinder 8.

The Invention claimed is

1. A chair lift apparatus for transporting an individual in a generally vertical path into and out of a water pool through an arc extending between a first radial position overlying the edge of the pool and a second radial position overlying the water, the apparatus comprising (a) a stationary support post vertically oriented in the pool water;

(b) cam guide means formed on the periphery of the support post and extending vertically along a substantial length of the support post, said cam guide having a helical twist near the upper end thereof, the degree of twist forming an arc leading between said first and second radial positions;

(c) fluid pressure responsive hydraulic cylinder means supported by said post with the wall of said cylinder surrounding said post and being movable reciprocally between an upper position with at least a first portion of the cylinder extending above the level of the pool edge and a lower position with at least a second portion of the cylinder extending beneath the surface of the water, said first and second portions having an overlapping segment;

(d) cam follower means attached to the lower end of the cylinder means between the cylinder wall and the post and cooperating with the cam guide means to rotate the cylinder through said arc as the cylinder moves near the upper end of its vertical travel;

(e) a carrier mounted on the overlapping segment of the cylinder means and adapted to receive and hold the individual during the transporting operation;

(f) and valve controlled fluid supply means for selectively supplying and emitting pressurized fluid to and from said cylinder to raise and lower the cylinder and carrier whereby the individual is transported between said first radial position with the individual oriented over the edge of the pool and said second radial position with the individual in the water.

2. The chair lift apparatus of claim 1 in which the cam guide means comprises a plurality of outwardly extending splines.

3. The chair lift apparatus of claim 2 in which the cam follower means includes a plurality of vertically extending passages aligned with the splines and a plurality of inclined cam follower surfaces adapted to engage the splines at the point of said helical twist.

* * * * *